United States Patent [19]

Zenglein et al.

[11] Patent Number: 4,583,924

[45] Date of Patent: Apr. 22, 1986

[54] GEAR PUMP, ESPECIALLY FOR MEDICAL PURPOSES

[75] Inventors: Wolfgang Zenglein, Schweinfurt; Franz-Josef Weinbeer, Traustadt, both of Fed. Rep. of Germany

[73] Assignee: Fresenius AG, Bad Homburg, Fed. Rep. of Germany

[21] Appl. No.: 669,632

[22] Filed: Nov. 7, 1984

[30] Foreign Application Priority Data

Nov. 10, 1983 [DE] Fed. Rep. of Germany ..... 3340748

[51] Int. Cl.[4] ..... F04B 17/00

[52] U.S. Cl. ..... 417/420; 418/206; 384/300

[58] Field of Search ..... 417/420; 418/206; 384/297, 299, 300

[56] References Cited

U.S. PATENT DOCUMENTS

| | | | |
|---|---|---|---|
| 2,302,966 | 11/1942 | MacNeil et al. | 418/206 |
| 2,672,823 | 3/1954 | Thomson et al. | 418/206 |
| 3,010,733 | 11/1961 | Melton et al. | 384/297 |
| 3,240,095 | 3/1966 | Steinway | 384/300 |
| 3,283,358 | 11/1966 | Merriam | 384/297 |
| 3,716,306 | 2/1973 | Martin, Sr. et al. | 417/420 |

FOREIGN PATENT DOCUMENTS

| | | | |
|---|---|---|---|
| 3045192 | 2/1983 | Fed. Rep. of Germany . | |
| 1139203 | 6/1957 | France . | |
| 1194511 | 11/1959 | France | 418/206 |
| 1299342 | 6/1962 | France . | |
| 1593463 | 5/1970 | France . | |
| 422011 | 1/1935 | United Kingdom | 418/206 |
| 828159 | 2/1960 | United Kingdom | 384/297 |

*Primary Examiner*—William L. Freeh
*Assistant Examiner*—Donald E. Stout
*Attorney, Agent, or Firm*—Cushman, Darby & Cushman

[57] ABSTRACT

A gear pump (1) comprises a pump housing (2) in which two stationary journals (12,13) are disposed. On the journals (12,13) a driving pump wheel (7) and a driven pump wheel (8) are mounted. The driving pump wheel (7) in the example is integrally joined to a shaft (16) which is constructed as hollow shaft and on which a hub (24) with a magnet (11) is disposed as part of a magnetic coupling of the gear pump (1). With this construction a wear of the journals (12,13) in their bearing region in the pump housing (2) under the action of aggressive cleaning agents such as acetic acid is prevented because the journals (12 and 13) do not rotate in their bearings. On the other hand, by provision of the shaft (16) constructed as hollow shaft the drive connection is established between the driving pump wheel (7) and the magnet (11) forming part of the magnetic coupling, and wear of the shaft (16) rotating on the journal (12) is prevented by constructing said shaft from a particularly anti-frictional plastic which is also used for the pump wheels (7 and 8).

10 Claims, 5 Drawing Figures

GEAR PUMP, ESPECIALLY FOR MEDICAL PURPOSES

Figure 1:
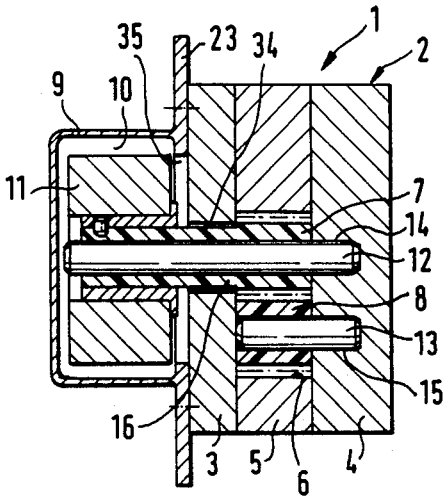

The invention relates to a gear pump, especially for medical purposes.

Gear pumps are used in medicine for example in the field of dialysis. A gear pump according to the preamble, used inter alia in this field of medicine, comprises a pump housing having a base plate, a cover plate and a housing center portion arranged therebetween. In the pump chamber of the housing center portion at least two pump wheels are disposed which in the case of the gear pump according to the preamble consist of a special steel such as Waukesha 88. The pump wheels are mounted on rotating shafts and on the shaft of the driving pump wheel, which is in engagement with the driven pump wheel, a magnet is mounted which forms a part of a magnetic coupling for transmitting the drive forces to the shaft of the driven pump wheel, Both the shafts of the pump wheels and their bearing bushes for mounting in the pump housing cinsist in the gear pump according to the preamble of a high-strength steel, for example Widia steel, to ensure proper guiding of the pump wheels and their shafts, which sometimes rotate at very hight speed.

However, a disadvantage is that the gear pump according to the preamble because of the expensive materials used and the complex production, in particular as regards the mounting of the rotating shafts of the pump wheels, is very costly to manufacture.

Furthermore, the gear pump according to the preamble has the serious disadvantage that in spite of the use of expensive materials which are considered wear-resistant in a considerable number of gear pumps used in particular in medicine after a relatively short operating time considerable wear occurs, in particular in the region of the shafts of the pump wheels and their bearings in the pump housing. As investigation carried out within the scope of the invention has shown this wear is due to material decompositions of the bearings and shafts due to the use of aggressive cleaning agents such as acetic acid. Since however a cleaning of the gear pumps in particular in the field of dialysis with such agressive cleaning agents is essential for reasons of hygiene the gear pump according to the invention is not very suitable for use in medicine because in spite of employing expensive materials it has proved prone to wear and trouble.

The problem underlying the invention is thus to provide a gear pump, in particular for medical puposes, which firstly is economical to manufacture and secondly has a high resistance to wear even in uses in which aggressive cleaning agents are employed.

By providing stationary spindles or axles for the pump wheels it is first achieved that in the gear pump according to the invention there are no bearings required for rotating shafts which are very prone to wear in particular when aggressive cleaning agents are employed. The gear pump according to the invention thus has the advantage that it can be used in fields in which the cleaning of the gear pump using aggressive media is essential and still has a high dependability because bearing wear cannot occur.

A further advantage of the gear pump according to the invention resides in that in the region between pump wheels and stationary axles by using suitable plastics no wear, or no appreciable wear, can occur and consequently the problem of wear is not simply transferred from the mounting of the rotating shafts to the mounting of the pump wheels rotating on staionary spindles. Further investigations made within the scope of the invention have shown that the use of pump wheels consisting of plastic is certainly practicable even in the critical fields referred to, in particular medicine.

The combination of pump wheels consisting of plastic with stationary axles or spindles has the further advantage that no lubrication at all is necessary in the gear pump according to the invention because the plastic pump wheels have very good running properties making it possible to dispense with a lubrication.

By providing the hollow shaft connected on the one hand to the driving pump wheel and on the other to one of the magnets of the magnetic coupling it is achieved that a drive connection between the magnet and the driving pump wheel is possible although the driving pump wheel is disposed freely rotatably on a stationary axle. Another advantage is that in the region of the hollow shaft no appreciable wear occurs because the latter consists of a very resistant plastic with very good running properties.

Although it would be fundamentally conceivable to mount the pump wheel on a rotating shaft which consists of a corresponding plastic and from the good running properties of which at least a reduced wear in the region of the shaft bearings could be expected, it has been found that such a construction would lead to a pump wheel shaft which is too weak and flexible and consequently this construction does not appear suitable. Since the shaft which connects the driving pump wheel to the magnet in the gear pump according to the invention is made as hollow shaft rotating on the stationary axle, in the gear pump according to the invention no problems at all are encountered as regards flexibility because the hollow shaft can be supported over its entire length on the stationary axle and moreover has a substantially greater effective diameter than in the aforementioned fundamentally conceivable alternative of a rotating shaft with a diameter which would correspond approximately to the diameter of the axles of the gear pump according to the invention. Correspondingly larger dimensioning of such conceivable plastic shafts is not practicable because of the increased space required and the consequently greater overall size of the gear pump.

If the pump wheels and the hollow shaft in accordance with the advantageous development of this invention are made from polytetrafluoroethylene graphite particularly favorable running properties on the stationary journals are obtained and furthermore this material has proved resistant in particular to all media used in the field of dialysis.

The driving pump unit and the hollow shaft unit may be made integral which has advantages as regards the production. Of course, these two components of the gear pump according to the invention may also be connected together in a different manner should this be necessary for any desired reasons. Thus, the pump wheel and the hollow shaft could be connected together by means of a pin connection.

If the journal of the driven pump wheel is supported only in the cover plate of the pump housing the advantage is obtained that a further guide recess in the base plate of the pump housing can be dispensed with and this reduces the production expenditure. A one-sided mounting of the journal is possible in the gear pump according to the invention because the journal is not excessively long and in addition on the side of the driven pump wheel the forces transmitted to the journal are not large enough to make a two-sided support necessary.

The possibility of adhering the stationary journals both of the driven and of the driving pump wheel in the cover plate of the pump housing has advantages in particular as regards the production technique because both from a material and from an assembly point of view adhering is less complicated.

If the magnet of the magnetic coupling is disposed on a hub which can be secured to the hollow shaft the advantage is obtained that the mounting of the magnet can be provided on a part independent of the hollow shaft so that the construction of the hollow shaft itself can be particularly adapted to the aspects of optimal running properties on the stationary journal and resistance to wear and the problem of mounting the magnet is restricted to the hub which need only be secured to the hollow shaft.

This is solved particularly advantageously by adhering the magnet to the hub and the assembly thereof on the hollow shaft can be further facilitated if the hub and the hollow shaft are connected together by means of a bayonet fastener.

Figure 2:
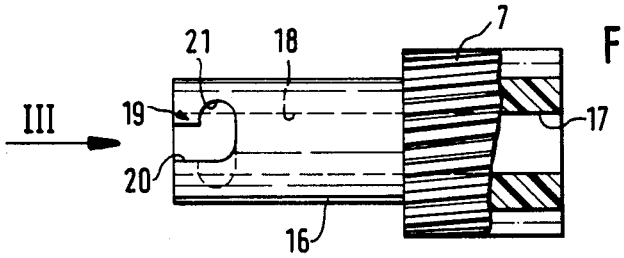
Figure 4:
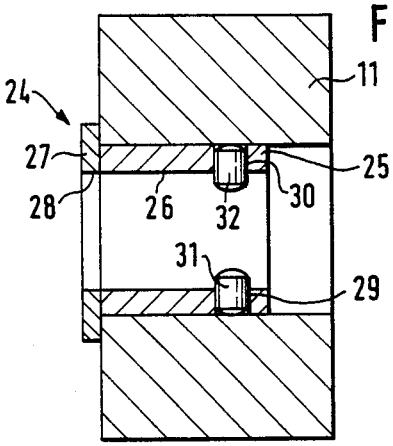
Figure 3:
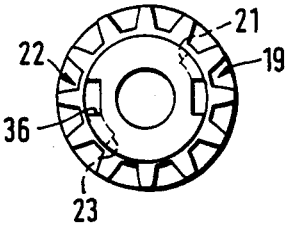
Figure 5:
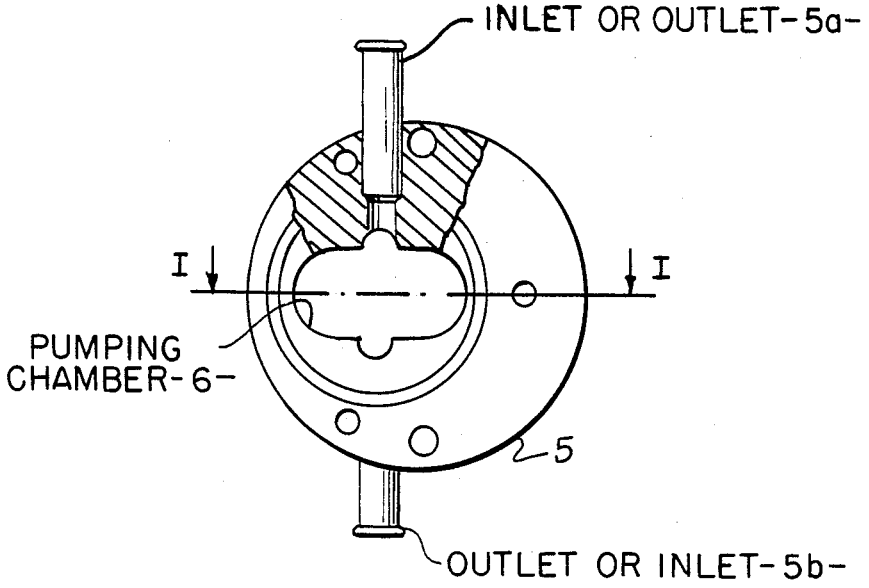

Further details, features and advantages of the invention will be apparent from the following description of an example of embodiment with the aid of the drawings wherein:

FIG. 1 shows a slightly simplified illustration in longitudinal section through a gear pump according to the invention, FIG. 2 is a partially sectioned enlarged illustration of a pump wheel and, connected thereto, a hollow shaft of the pump according to FIG. 1, FIG. 3 is a view of the gear and hollow shaft according to FIG. 2 seen from the direction of the arrow III of FIG. 2, FIG. 4 is a longitudinal section corresponding to FIG. 2 through a hub and a magnet mounted thereon of the gear pump according to FIG. 1, and FIG. 5 is a top plan of the structure of FIG. 1, partly broken away to reveal internal construction.

FIG. 1 shows a gear pump 1 according to the invention which is particularly suitable for medical purposes, such as dialysis. The gear pump 1 comprises a pump housing 2 having a base plate 3, a cover plate 4 and a housing center portion 5. The housing center portion 5 is disposed between the base plate 3 and the cover plate 4 and connected to the latter for example by means of screws or similar securing means. The housing center portion 5 comprises a pump chamber 6 in which in the example two pump wheels 7 and 8 are disposed. The pump wheel 7 is the driving pump wheel and the pump wheel 8 is the driven pump wheel. For this purpose the pump wheel 8 meshes with the pump wheel 7. As shown in FIG. 5, the pump fluid enters the pumping chamber 6 by means of inlet 5*a* or 5*b* and exits through the other of these openings, in a conventional manner as shown and described by U.S. Pat. No. 3,716,306 to Martin, Sr. et al, herein expressly incorporated by reference.

A hood 9 is also mounted in a manner not shown in detail on the pump housing 2 of the gear pump 1 according to the invention. In the interior 10 of the hood 9 a magnet 11 is disposed which forms part of a magnetic coupling, not illustrated in detail, for transmitting the drive forces for the gear pump 1.

According to the invention the pump wheels 7 and 8 are each mounted on a stationary journal 12 and 13 respectively. For this purpose the journals 12 and 13 are mounted in corresponding guide or support recesses 14 and 15 respectively of the cover plate 4, adhesion being used in the example for this purpose. For example, V4A steel has proved to be a suitable material for the journals 12 and 13 and a suitable joining agent for connection to the cover plate 4 is for example an adhesive designated Loctite 648. This securing permits the journals 12 and 13 to be exactly mounted in the pump housing 2 making other guide or support recesses or the like unnecessary. This has the advantage that additional guide recesses in the base plate 3 can be dispensed with and this considerably reduces the production expenditure for the latter.

It has been found that a particularly suitable material for the pump wheels 7 and 8 is polytetrafluoroethylene graphite (Teflon graphite) because this material has particularly good running properties so that there is no wear or negligible wear between the pump wheels 7 and 8 and the associated journals 12 and 13 respectively. Furthermore, said material for the pump wheels 7 and 8 is resistant to all the usual agents required by gear pumps in medical use, for example dialysis, or used for the cleaning thereof.

To further improve the already good running properties or antifrictional qualities and in particular the noise level of the gear pump 1 according to the invention the pump wheels 7 and 8 may be provided with a helical toothing and for this purpose the driving pump wheel 7 can be helically toothed for example 6° left whilst the driven pump wheel can have a complementary toothing inclination of 6° to the right.

As further apparent from FIG. 1 the driving pump wheel 7 is connected to a shaft 16 which according to the invention is made as hollow shaft. In the example the shaft 16 is connected integrally to the pump wheel 7 and consists of the same plastic. As apparent from FIG. 2 the integral construction of the pump wheel 7 and shaft 16 provides a compact stable unit which is able also to transmit large torques. The integral construction of the pump wheel and shaft 16 illustrated in the example may however if necessary be replaced by a connection between 2 separate components, a pin connection being for example suitable.

As further apparent form FIG. 2 the pump wheel 7 and the shaft 16 constructed as hollow shaft each comprise a passage 17 and 18 respectively which in the case of integral construction form single continuous passage. At the side remote from the pump wheel 7 the shaft 16 comprises a locking recess 19 which comprises a region 20 extending in the axial direction of the shaft and a region 21 extending in the radial direction of the shaft 16. As apparent form FIG. 3 on the side of the shaft 16 diametrically opposite the locking recess 19 a further locking recess 22 is provided which is formed corresponding to the formation of the locking recess 19 except that the radial regions 21 and 23 of the locking recesses 19 and 22 respectively in accordance with the illustration selected in FIG. 3 extend in the one case upwards and in the other case downwards, i.e., are symmetrical with respect to the center of the shaft 16.

As shown by FIG. 4 the magnet 11 is disposed on a hub 24 which comprises a sleeve 25 cylindrical in the example having an inner recess 26 and an annular flange 27 disposed at one end of the sleeve 25. The annular flange 27 comprises an inner recess 28 having a diameter corresponding to the inner recess of the sleeve 25. The sleeve 25 is further provided with two recesses 29 and 30 which are opposite each other in the radial direction and in which locking pins 31 and 32 are secured for example by means of an adhesive. The magnet 11 itself is disposed on the outer periphery of the sleeve 25 and for this purpose can also be secured by adhesive to the sleeve 25.

As again apparent from FIG. 1 the pump wheel 7 and the shaft 16 connected thereto are disposed on the journal 12, the shaft 16 being supported over its entire length on the journal 12 so that in spite of the plastic material for the shaft 16 there is no danger of sagging. For the passage of the shaft 16 through the base plate 3 and a connecting flange 23 of the hood 9 the latter have passages 34 and 35. As also shown by FIG. 1 the hub 24 with the magnet 11 mounted thereon is disposed in the example on the region of the shaft 16 projecting into the space 10 of the hood 9, the locking pins 31 and 32 engaging in the corresponding locking recesses 19 and 22 respectively. In the embodiment illustrated the locking recesses 19 and 23 and the locking pins 31 and 32 form a bayonet fastener which builds up its locking action after a rotation of the hub 24, the locking pins 31 and 32 initially being introduced into the axial regions 20 and 36 respectively of the locking recesses 19 and 22. After rotation of the hub the locking pins 31 and 32 are introduced into the radial regions 21 and 23 of the locking recesses 19 and 22 respectively, whereafter the locking pins 31 and 32 engage behind the corresponding adjacent wall regions of the shaft 16 so that the hub 24 is prevented from sliding down the hollow shaft 16.

Thus, to assemble the gear pump 1 described above before fitting the hub 24 to the shaft 16 it is only necessary to secure the journals 12 and 13 in the cover plate 4 of the pump housing 2, whereafter the pump wheels 7 and 8 can be fitted to the journals 12 and 13 respectively. In the fitting of the pump wheel 7 the shaft 16 connected thereto is also disposed on the journal 12, whereafter the hub 24 with the magnet 11 is secured in the manner described above on the shaft 16. All other assembly for final connection of the cover plate 4, the base plate 3 and the housing center portion 6 as well as the securing of the hood 9 on the pump housing 2 can be performed in the usual manner.

The assembly steps described above show that the gear pump 1 according to the invention can be assembled in extremely expedient and rapid manner and that because of the provision of two stationary journals 12 and 13 a number of complicated production and assembly steps as otherwise necessary in gear pumps with rotating shafts for the pump wheels 7 and 8 can be omitted. On the other hand, in the gear pump 1 according to the invention the drive connection between the magnet 11 and the driving pump wheel 7 is nevertheless insured in extremely simple manner by means of the shaft 16 constructed as hollow shaft and in spite of the formation thereof from plastic adequate stability is achieved because the shaft 16 is mounted over its entire length on the journal 12. On the other hand, the wear is not increased because the shaft 16 like the pump wheels 7 and 8 can be made from a wear-resistant plastic with very good antifrictional properties which is moreover resistant to all the agents usual in particular in medicine.

We claim:

1. Gear pump, in particular for medical purposes, comprising a pump housing having a base plate, a cover plate and a housing center portion which is disposed therebetween and therewith defines a pump chamber having an inlet and an outlet, at least two pump wheels being disposed in said chamber, one of which drives and at least a further of which is driven, the driven pump wheel having a bearing opening and consisting of plastic and rotating with its bearing opening to form a plastic-metal antifrictional pairing directly on a stationary journal of metal which is mounted in the pump housing, characterized in that (a) the driving pump wheel also consists of plastic and is connected to a drive shaft of plastic, (b) the drive shaft is constructed as a hollow shaft couplable to a drive member and in a passage recess passes unguided through the base plate and that the driving pump wheel is disposed on a stationary journal of metal mounted in the pump housing, (c) the driving pump wheel like the driven pump wheel forms with the surface of the journal a plastic-metal antifrictional pairing, (d) the drive member is disposed outside the base plate of the pump housing and is constructed as the magnet of a magnetic coupling, and (e) the journal for mounting the driving pump wheel extends into the axial region of the drive member and supports the hollow shaft from the inside to form a plastic-metal antifrictional pairing.

2. Gear pump according to claim 1, characterized in that the material of the pump wheels and of the shaft is polytetrafluoroethylene.

3. Gear pump according to claim 1, characterized in that the driving pump wheel and the shaft constructed as a hollow shaft are made integral with each other.

4. Gear pump according to claim 1, characterized in that the journal of the driven pump wheel is guided only in the cover plate (4).

5. Gear pump according to claim 1, characterized in that the stationary journals are adhered into the cover plate.

6. Gear pump according to claim 1, characterized in that the magnet is disposed on a hub which is secured to the hollow shaft.

7. Gear pump according to claim 6, characterized in that the magnet is adhered to the hub.

8. Gear pump according to claim 6, characterized in that the hub is provided with a recess whose inner diameter is adapted to the outer diameter of the shaft constructed as hollow shaft.

9. Gear pump according to claim 8, characterized in that at least one locking pin projects radially inwardly into the recess of the hub and engages in a matching locking recess of the hollow shaft.

10. Gear pump according to claim 9, characterized in that the connection between hub and shaft is constructed as a bayonet fastener and that the hub is disposed on the shaft.

* * * * *